United States Patent [19]

Salter et al.

[11] Patent Number: 4,491,422

[45] Date of Patent: Jan. 1, 1985

[54] PORTABLE SPOT MIXING APPARATUS

[76] Inventors: Franklin J. Salter, Box 134, Modale, Iowa 51556; Jack L. Purcell, 515 N. Boston, Missouri Valley, Iowa 51555

[21] Appl. No.: 518,723

[22] Filed: Jul. 29, 1983

[51] Int. Cl.[3] ..... B01F 7/24; B01F 15/00

[52] U.S. Cl. ..... 366/343; 366/279; 366/318; 366/601

[58] Field of Search ..... 366/129, 249, 254, 279, 366/281, 282, 283, 284, 285, 318, 331, 343, 347, 601, 261; 34/179, 181, 183; 175/394

[56] References Cited

U.S. PATENT DOCUMENTS

| | | | |
|---|---|---|---|
| 1,119,168 | 12/1914 | Keppeler | 366/343 X |
| 2,151,146 | 3/1939 | Petry | 366/331 |
| 2,162,400 | 6/1939 | Heath | 366/331 X |
| 2,449,313 | 9/1948 | Naef | 175/394 X |
| 2,733,900 | 2/1956 | Wobensmith | 366/605 X |
| 2,766,014 | 10/1956 | Hanson | 255/70 |
| 2,846,192 | 8/1958 | Ostling | 255/69 |
| 3,156,541 | 11/1964 | Kalke | 366/318 X |
| 3,198,493 | 8/1965 | Sukup | 366/261 |
| 3,297,309 | 1/1967 | Adams | 366/282 X |
| 3,356,168 | 12/1967 | Johnson | 175/394 |
| 3,422,913 | 1/1969 | Young, Jr. | 175/394 |
| 3,602,321 | 8/1971 | Kortschaga | 175/18 |
| 3,710,877 | 1/1973 | Michasiw | 175/18 |
| 3,856,272 | 12/1974 | Ravitts | 366/261 X |
| 3,960,370 | 6/1976 | Bewley | 366/347 |
| 4,340,310 | 7/1982 | Clark | 366/601 X |

*Primary Examiner*—Philip R. Coe
*Assistant Examiner*—Frankie L. Stinson
*Attorney, Agent, or Firm*—Henderson & Sturm

[57] ABSTRACT

A portable spot mixing apparatus (10) including a drive unit (11), a mixing unit (12), a handle (13), and a brake unit (14). The mixing unit (12) serves to stir and mix grain (53) within a specified local area and the brake unit (14) prevents the apparatus (10) from becoming buried in the grain (53) during use.

7 Claims, 7 Drawing Figures

PORTABLE SPOT MIXING APPARATUS

TECHNICAL FIELD

This invention relates generally to portable mixing apparatus, and more particularly to portable spot mixing apparatus for spot mixing grain stored in a grain bin.

BACKGROUND ART

Large quantities of harvested grain are typically stored in large bins. Often, grain becomes deposited in such a bin immediately upon being harvested. Such grain must be dried and cured to reduce its moisture content in order to assure safe long term storage.

To assist in this drying process, an operator can install large permanently mounted stirring equipment in the grain bin. Such equipment serves to stir the entire mass of grain stored in the bin. The obtainment and use of such equipment, however, poses certain drawbacks.

In addition to being expensive to purchase and install, such equipment may be relatively expensive to operate. For instance, if only a small area of grain needs to be mixed, much time and energy will be wasted through use of this equipment.

Grain bin operators frequently discover small areas near the upper surface of the grain mass that require mixing in order to permit the drying process to proceed. To date, such operators have a choice of either ignoring the problem and accepting the loss, or of installing and operating the permanently installed mixing apparatus.

There exists a need for a portable spot mixing apparatus that may be used to mix relatively small masses of grain within a grain bin.

DISCLOSURE OF INVENTION

The above need is substantially met by the invention disclosed herein. This invention comprises a portable spot mixing apparatus that includes generally a drive unit, a mixing unit, a handle and a brake unit.

The drive unit may be provided by any suitable mechanism for imparting rotational movement. A small electric motor works well in this regard.

The mixing unit may be provided by a longitudinal member resembling an auger. Unlike an auger, the mixing unit has no pointed end, or other cutting, biting or gripping surfaces disposed thereon. Flighting disposed about the shaft of the mixing unit rotates and causes grain disposed thereabout to become mixed.

The handle may be any appropriate handle configuration that allows an operator to transport and implement the apparatuus where desired.

The brake unit comprises a plate disposed substantially normal to the axis of the mixing unit. During use, an operator allows the mixing unit to contact the surface of the grain mass, and thereafter burrow its way into the grain mass. The brake unit prevents the apparatus from completely submerging beneath the grain. The operator may then leave the apparatus in place to allow the grain to become thoroughly mixed without concern that the apparatus will bury itself or become disposed at some inappropriate angle.

BRIEF DESCRIPTION OF THE DRAWINGS

These and other attributes of the invention will become more clear upon a thorough review and study of the following description of the best mode for carrying out the invention, particularly when reviewed in conjunction with the drawings, wherein.

BEST MODE FOR CARRYING OUT THE INVENTION

Figure 1:
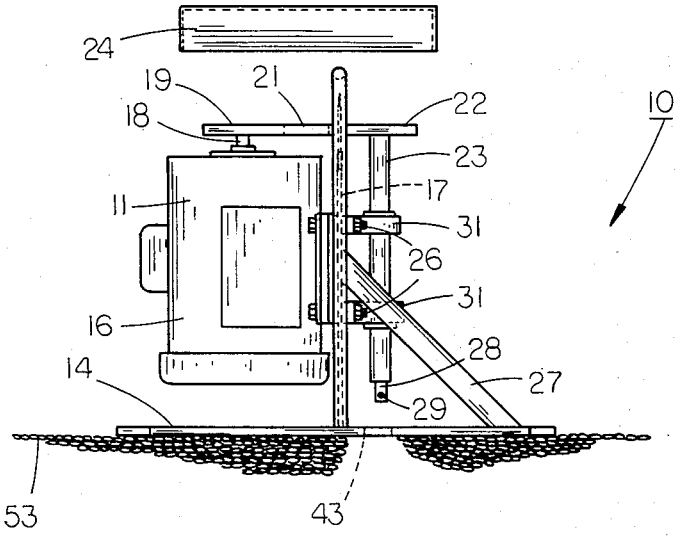
FIG. 1 provides a side elevational view of the apparatus with the handle not attached and the mixing unit shown disconnected from the drive unit.
Figure 1:
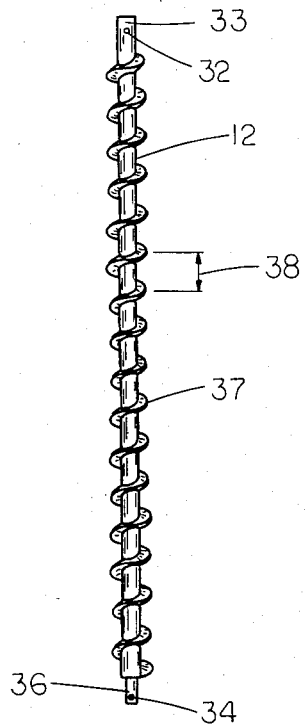

Referring now to the drawings, and in particular to FIG. 1, the apparatus of the invention may be seen as depicted generally by the numeral 10. The apparatus (10) includes generally a drive unit (11), a mixing unit (12), a handle (13) (see FIG. 2), and a brake unit (14). These general components will now be described in more detail in seriatim fashion.

The drive unit (11) includes generally a motor (16), a motor mount plate (17), a motor shaft (18), a motor pulley (19), a drive belt (21), a drive shaft pulley (22), a drive shaft (23), and a cowling (24).

The motor (16) may be comprised of a Dayton Model 6K592F electric motor having approximately ½ horsepower. This motor connects by appropriate connecting means such as bolts (26) to a motor mount plate (17). This motor mount plate may be connected to the brake unit (14). In addition, the motor mount unit (17) may be supported in place by two angularly disposed support struts (27) that connect between the motor mount plate (17) and the brake unit (14).

The motor (16) should be mounted sufficiently distant from the brake unit (14) such that grain will not become lodged therebetween.

The motor (16) connects by way of a motor drive shaft (18) to a motor pulley (19). This pulley (19) connects by way of a drive belt (21) to a drive shaft pulley (22).

The drive shaft pulley (22) connects to a drive shaft (23) having a lower end that connects to a narrower rod (28). This rod (28) includes a hole (29) disposed radially therethrough for receiving a locking pin.

In the embodiment depicted, the drive shaft (23) may be held substantially in place by two bearing units (31). These bearing units (31) may be connected to the motor mount plate (17).

In order to protect the drive belt (21) from becoming fouled and to protect the operator therefrom, a cowling (24) may be fit over the belt (21) and held in place by any appropriate means.

The mixing unit (12) may be comprised of a shaft approximately three to four feet in length. This shaft may have an exterior diameter of approximately one inch and may be substantially hollow in order to reduce weight (great strength need not be provided for since the mixing unit (12) only mixes grain and does not serve any other more strenuous function).

A hole (32) may be disposed through the upper end (33) of the mixing unit (12), and another hole (34) may be disposed through the distal end (36). Both of these holes (32 and 34) are provided to receive locking pins as described below.

Figure 5:
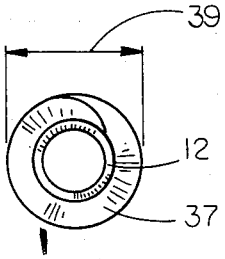
FIG. 5 provides an enlarged bottom plan view of the mixing unit.

The flighting (37) disposed in a helical manner about the shaft of the mixing unit (12) has approximately one and one-half inches space between each revolution as depicted by the numeral 38. Referring momentarily to FIG. 5, the flighting (37) has a diameter of approximately two inches as depicted by the numeral 39.

The mixing unit (12) may be affixed to the drive shaft (23) of the drive unit (11) by disposing the upper end (33) of the mixing unit (12) about the rod (28) connected to the drive shaft (23). The holes (32 and 29) disposed through the mixing unit (12) and the rod (28) may be aligned, and a locking pin may be disposed therethrough to hold the mixing unit (12) operably connected to the drive unit (11).

Figure 2:
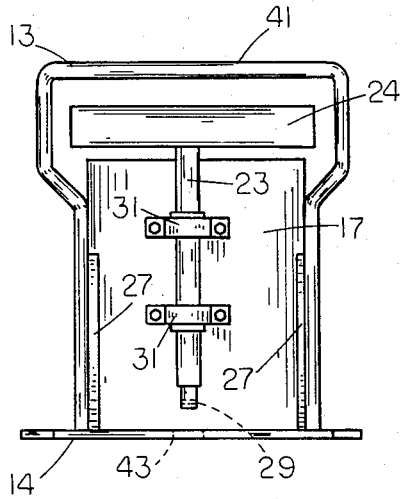
FIG. 2 comprises a front elevational view of the handle and a portion of the drive unit.

Referring to FIG. 2, the handle (13) may be comprised of any appropriately configured handle mechanism. In this embodiment, the handle may be affixed to both the brake unit (14) and the motor mount plate (17). The handle provides a hand graspable upper portion (41), such that the apparatus (10) may be easily grasped, lifted, transported and operated.

Figure 3:
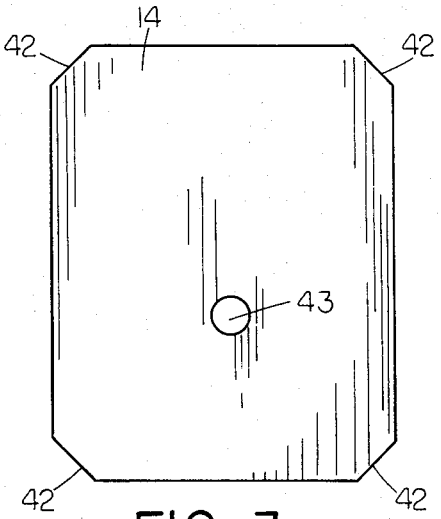
FIG. 3 comprises a bottom plan view of the brake unit.

Referring to FIG. 3, the brake unit (14) may be comprised of a rectangular shaped plate. The corners (42) of this plate have been truncated to minimize the risk of injury to an operator. The brake unit (14) includes a hole (43) disposed therethrough for receiving the mixing unit (12).

Figure 4:
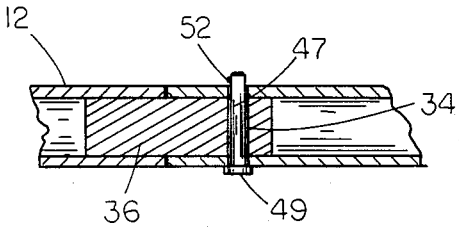
FIG. 4 comprises an enlarged, sectioned, detail view of a method for securing two mixing units together.

Two or more mixing units (12) may be axially attached to one another by use of an attachment sleeve (44) (see FIG. 4). Such an attachment sleeve (44) may be comprised of a hollow or solid cylinder having an exterior dimension appropriate for allowing it to fit within the hollow ends of the mixing units (12). The attachment sleeve (44) further includes holes (46) disposed radially through each end, which holes (46) may be aligned with the holes disposed through the ends of the mixing units (12). A locking pin (47) may then be disposed through such aligned holes to secure each mixing unit to the attachment sleeve (44), and hence, to operably attach the mixing units (12) together.

Figure 6:
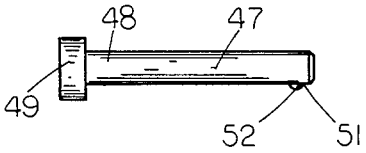
FIG. 6 provides an enlarged view of a locking pin suitable for use with this invention.

Referring to FIG. 6, a locking pin (47) suitable for use in attaching the mixing unit (12) to the drive shaft (23) and for securing one mixing unit (12) to another may be seen. Such locking pins are well known in the art, and comprise a longitudinal member (48) for disposition through the holes provided. One end of the longitudinal member (48) has a plate (49) secured thereto and the remaining end has a recess (51) formed therein with a ball (52) disposed therein. This ball (52) is biased outwardly to extend beyond the dimensions of the longitudinal member (48).

The longitudinal member (48) may be disposed through a hole, and the ball (52) will prevent the member (48) from accidentally slipping out. The locking pin (47) can be removed by exerting a sufficient force on the pin (47) to force the ball (52) within the recess (51) to allow the longitudinal member (48) to be withdrawn.

Substantially all of the above components (with the primary exception of the motor (16)) may be comprised of aluminum. This substantially reduces weight and makes the unit more appropriate for portable use.

Figure 7:
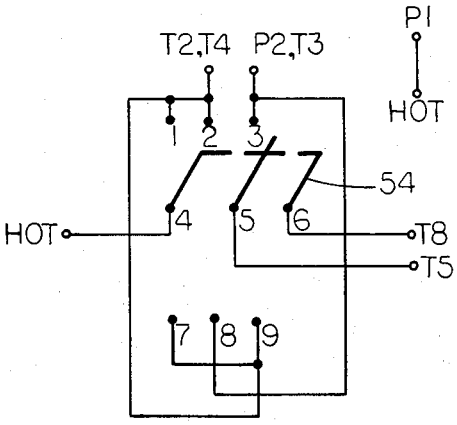
FIG. 7 provides a schematic diagram of a switch that may be used with the drive unit.

Referring now to FIG. 7, a switch that may be utilized with the apparatus (10) will be described. Such a switch (54) may be comprised of a three pole triple throw switch. The Dayton motor (16) referred to above has a number of leads designated P1, P2, T2, T3, T4, T5 and T8. The connections between this motor (16) and the terminals of the switch (54), and the interconnections between the terminals themselves, are as follows.

The first terminal of the switch (54) connects to the second terminal and to the ninth terminal thereof. The second terminal connects to the T2 and T4 leads of the motor (16). The third terminal connects to the P2 and T3 leads of the motor (16) and to the eighth terminal of the switch (54). The fourth terminal connects to one side of an AC power source, the other side of which connects to the P1 lead of the motor (16). The fifth terminal connects to the T5 lead and the sixth terminal connects to the T8 lead of the motor (16). Finally, the seventh terminal connects to the ninth terminal of the switch (54).

With the switch (54) positioned in the central position, the motor (16) will be disconnected from the power source and will not operate. With the switch (54) closed such that the fourth terminal contacts the first, the fifth contacts the second, and the sixth contacts the third, the motor (16) will rotate the mixing unit (12) such that grain may be mixed. With the switch (54) closed in the opposite direction, such that the fourth terminal contacts the seventh, the fifth contacts the eighth, and the sixth contacts the ninth, the motor (16) will rotate the mixing unit (12) in the opposite direction. Such opposite rotation can make removal of the mixing unit (12) from the grain easier.

To use the invention, an operator locates an area of grain (53) (see FIG. 1) that requires mixing. The drive unit (11) may then be activated to cause the mixing unit (12) to rotate. The mixing unit (12) may then be brought in contact with the grain (53).

The apparatus (10) may then be lowered until the brake unit (14) comes in contact with the grain (53). The apparatus (10) will then be prevented from moving any further into the grain (53). The mixing unit (12) may then be left in place for an appropriate time to allow the grain disposed proximal to the mixing unit (12) to become mixed.

The apparatus (10) may then be easily removed from the grain (53) and either moved to another location where mixing is required or deactivated.

Obviously, numerous modifications and variations of the present invention are possible in light of the above teachings. It is therefore to be understood that within the scope of the appended claims, the invention may be practiced otherwise than as specifically described therein.

I claim:

1. A portable spot mixing apparatus for use in mixing grain, the apparatus comprising:

(a) drive means for imparting rotational movement;

(b) mixing means operably connectable to said drive means for mixing at least part of said grain;

(c) a handle connected to said apparatus for facilitating the portability of said apparatus and for allowing an operator to selectively locate said apparatus with respect to said grain; and (d) a plate attached to said apparatus and disposed substantially normal to the axis of said mixing means for preventing said apparatus from becoming buried in said grain during use.

2. The apparatus of claim 1 wherein said mixing means comprises a shaft having flighting disposed thereabout.

3. The process of claim 2 wherein said shaft is substantially hollow.

4. The apparatus of claim 3 wherein said flighting is evenly distributed along the entire length of said shaft.

5. The apparatus of claim 4 wherein said shaft includes a hole disposed through one end thereof for facilitating the connection of said shaft to said drive means.

6. The apparatus of claim 1 wherein:

(a) said drive means includes:

(i) a motor;

(ii) a rotatable drive shaft; and (iii) a belt for connecting said motor and said drive shaft such that said motor may impart rotational movement to said drive shaft;

(b) said mixing means includes;

(i) a substantially hollow shaft that may be operably connected to said drive shaft; and (ii) flighting helically disposed evenly about said shaft.

7. The apparatus of claim 1 and further including switch means operably connected to said drive means, for controlling the direction of rotation imparted by said drive means.

* * * * *